US007484555B2

(12) United States Patent
Beamer et al.

(10) Patent No.: US 7,484,555 B2
(45) Date of Patent: Feb. 3, 2009

(54) HEAT EXCHANGER ASSEMBLY

(75) Inventors: Henry Earl Beamer, Middleport, NY (US); David A. Southwick, Pittsford, NY (US)

(73) Assignee: Delphi Technologies, Inc., Troy, MI (US)

( * ) Notice: Subject to any disclaimer, the term of this patent is extended or adjusted under 35 U.S.C. 154(b) by 40 days.

(21) Appl. No.: 11/634,762

(22) Filed: Dec. 6, 2006

(65) Prior Publication Data

US 2008/0023186 A1 Jan. 31, 2008

Related U.S. Application Data

(63) Continuation-in-part of application No. 11/492,477, filed on Jul. 25, 2006.

(51) Int. Cl.
*F28F 9/02* (2006.01)
*F28F 9/22* (2006.01)

(52) U.S. Cl. ..... 165/174; 165/153; 165/176

(58) Field of Classification Search ..... 165/152, 165/153, 173, 174, 175, DIG. 481, DIG. 482, 165/DIG. 483
See application file for complete search history.

(56) References Cited

U.S. PATENT DOCUMENTS

| | | | |
|---|---|---|---|
| 1,684,083 | A | 6/1927 | Bloom |
| 1,701,617 | A | 2/1929 | Hyde |
| 2,419,575 | A | 4/1947 | Leonard |
| 3,976,128 | A | 8/1976 | Patel et al. |
| 5,088,294 | A | 2/1992 | Ando |
| 5,090,477 | A | 2/1992 | Sprow et al. |
| 5,174,373 | A | 12/1992 | Shinmura |
| 5,186,248 | A | 2/1993 | Halstead |
| 5,203,407 | A | 4/1993 | Nagasaka |
| 5,445,219 | A | 8/1995 | Hutto et al. |
| 5,503,223 | A | 4/1996 | Choi et al. |
| 5,586,600 | A | 12/1996 | Cribari |
| 5,622,219 | A | 4/1997 | Voss et al. |
| 5,638,900 | A | 6/1997 | Lowenstein et al. |
| 5,651,268 | A | 7/1997 | Aikawa et al. |
| 5,685,366 | A | 11/1997 | Voss et al. |
| 5,752,566 | A | 5/1998 | Liu et al. |

(Continued)

FOREIGN PATENT DOCUMENTS

| | | |
|---|---|---|
| EP | 1 015 838 | 7/2000 |

(Continued)

OTHER PUBLICATIONS

European Search Report dated Oct. 30, 2007.

*Primary Examiner*—Teresa J Walberg
(74) *Attorney, Agent, or Firm*—Patrick M. Griffin

(57) ABSTRACT

A heat exchanger assembly includes a first and second manifold. Each of the manifolds includes a tubular wall and a pair of manifold ends spaced from each other defining a flow path. A plurality of flow tubes extend between the manifolds and are in fluid communication with the flow paths. An insert is slidably disposed in the flow path of the first manifold. The insert divides the flow path into a plurality of chambers. The chambers and the flow tubes cooperate to establish a plurality of flow passes. The flow passes are for directing a heat exchange fluid through the heat exchanger assembly. The chambers are useful for orienting and connecting plumbing connections at various locations along the manifolds.

10 Claims, 8 Drawing Sheets

U.S. PATENT DOCUMENTS

| | | | | |
|---|---|---|---|---|
| 5,765,633 | A | 6/1998 | Hu | |
| 5,806,586 | A | 9/1998 | Osthues et al. | |
| 5,836,382 | A | 11/1998 | Dingle et al. | |
| 5,896,754 | A | 4/1999 | Balthazard et al. | |
| 5,927,397 | A | 7/1999 | Yasuda et al. | |
| 5,941,303 | A | 8/1999 | Gowan et al. | |
| 5,971,065 | A | 10/1999 | Bertilson et al. | |
| 5,988,267 | A | 11/1999 | Park et al. | |
| 6,082,448 | A | 7/2000 | Haussmann | |
| 6,125,927 | A | 10/2000 | Hubert | |
| 6,161,616 | A | 12/2000 | Haussmann | |
| 6,168,415 | B1 | 1/2001 | Pleasant et al. | |
| 6,220,342 | B1 | 4/2001 | Nishishita et al. | |
| 6,267,173 | B1 * | 7/2001 | Hu et al. | 165/132 |
| 6,276,447 | B1 | 8/2001 | Iguchi et al. | |
| 6,341,648 | B1 | 1/2002 | Fukuoka et al. | |
| 6,769,269 | B2 | 8/2004 | Oh et al. | |
| 6,892,805 | B1 | 5/2005 | Valensa | |
| 2003/0116310 | A1 | 6/2003 | Wittmann et al. | |
| 2004/0026072 | A1 | 2/2004 | Yi et al. | |
| 2004/0159121 | A1 * | 8/2004 | Horiuchi et al. | 165/153 |
| 2005/0006057 | A1 * | 1/2005 | Rauser | 165/174 |
| 2005/0006081 | A1 * | 1/2005 | Kamiyama et al. | 165/174 |

FOREIGN PATENT DOCUMENTS

| | | |
|---|---|---|
| EP | 1 365 200 | 11/2003 |
| FR | 2 735 851 | 12/1996 |
| JP | 1067592 | 3/1989 |
| JP | 10009713 | 1/1998 |
| WO | WO 94/14021 | 6/1994 |

* cited by examiner

HEAT EXCHANGER ASSEMBLY

CROSS REFERENCE TO RELATED APPLICATION

This application is a continuation-in-part of U.S. patent application Ser. No. 11/492,477 filed on Jul. 25, 2006, the advantages and disclosure of which are hereby incorporated by reference.

BACKGROUND OF THE INVENTION

1. Field of the Invention

The present invention generally relates to a heat exchanger assembly. More specifically, the present invention relates to a heat exchanger assembly including an insert for directing a heat exchange fluid through the heat exchanger assembly.

2. Description of the Related Art

Heat exchanger assemblies such as evaporators and condensers are well known to those skilled in the art of thermal science. The heat exchanger assemblies may be used for vehicles, such as cars and trucks. The heat exchanger assemblies may also be used for buildings, such as homes and factories. The heat exchanger assemblies generally include a pair of spaced and parallel manifolds with a series of parallel flow tubes extending therebetween. The flow tubes communicate a heat exchange fluid, i.e., a refrigerant, between the two manifolds. Air fins are disposed between the flow tubes to add surface area to the heat exchanger assembly for further aiding in heat transfer to or from ambient air passing over the flow tubes. The heat exchanger assemblies include an inlet port and an outlet port for transferring the refrigerant to and from the heat exchanger assembly, respectively, in a continuous closed-loop system.

In one-pass heat exchanger assemblies, such as down-flow and cross-flow heat exchanger assemblies, the inlet port is disposed in one manifold, and the outlet port is disposed in the other manifold. Typically, the inlet port and the outlet port are diagonal to each other, attempting to fully utilize all of the flow tubes between the manifolds. Conversely, in a multi-pass heat exchanger assembly, both the inlet port and the outlet port may be spaced apart and disposed in the same manifold. However, the inlet and outlet port may also be diagonal to each other in the manifolds. In the multi-pass heat exchanger assemblies, a plurality of baffles is fixed within each of the manifolds to form a plurality of flow passes. In a typical heat exchange loop, the refrigerant enters through the inlet port into one of the manifolds, flows through all of the flow passes between the manifolds, and then exits one of the manifolds through the outlet port.

In the multi-pass heat exchanger assemblies, the inlet and outlet ports must be in locations dictated by location of the baffles and the flow passes. For example, the inlet port must be located near a first flow pass and the outlet port must be located near a last flow pass. External plumbing connections are required to meet orientation and location requirements of the inlet and outlet port. This often occurs in vehicles, where the heat exchanger assembly is tightly packed next to an engine. While the external plumbing connections help to route the refrigerant to and from the heat exchanger assembly, the external plumbing connections are often complex, which increases cost and takes up space. Internal plumbing within the heat exchanger itself can eliminate some of the problems associated with the external plumbing connections and with the inlet and outlet port locations.

Heat exchanger assemblies with internal plumbing are disclosed, for example, in U.S. Pat. No. 5,186,248 to Halstead (the '248 patent). The '248 patent discloses a heat exchanger assembly having a pair of manifolds with a series of parallel flow tubes extending therebetween. The heat exchanger assembly has an inlet port for receiving a refrigerant and an internal outlet port for directing the refrigerant within the heat exchanger assembly. An outlet tank is integrally extruded with one of the manifolds and is connected to the internal outlet port. The outlet tank has an outlet port. A plurality of baffles is fixed in the manifolds to make a plurality of flow passes within the heat exchanger assembly. The refrigerant flows into the inlet port and through the flow passes. The refrigerant then flows through the internal outlet port and into the outlet tank, and then out of the heat exchanger assembly through the outlet port.

Heat exchanger assemblies with internal plumbing are also disclosed, for example, in U.S. patent application Ser. No. 5,203,407 to Nagasaka (the '407 patent). The '407 patent discloses a heat exchanger assembly having a pair of manifolds with a series of parallel flow tubes extending therebetween. An inlet tank is attached to one of the manifolds and an outlet tank is attached to the other manifold. The inlet tank has an inlet port and the outlet tank has an outlet port. A plurality of baffles is fixed in the manifolds to make a plurality of flow passes within the heat exchanger assembly. A refrigerant flows through the inlet port and into the inlet tank. The refrigerant flows through the flow passes and enters into the outlet tank and out of the heat exchanger assembly through the outlet port.

The heat exchanger assemblies of the '248 and '407 patents are characterized by one or more inadequacies. Specifically, the heat exchanger assemblies of the '248 patent are limited to one configuration of the inlet and outlet port location due to an extrusion process employed to form the outlet tank integral with one of the manifolds. In addition, the internal outlet port must be properly located and made, which increases manufacturing costs of the heat exchanger assemblies. The heat exchanger assemblies of the '248 patent are also made of many pieces, which further increases manufacturing costs. The heat exchanger assemblies of the '407 patent are also extruded and made of many pieces, which increases manufacturing costs. In addition, location of the inlet and outlet tanks limits the heat exchanger assemblies to one configuration.

Accordingly, it would be advantageous to provide a heat exchanger assembly that can be configured into one or more configurations of inlet and outlet port locations. In addition, it would also be advantageous to provide a heat exchanger assembly having a lowered manufacturing cost.

SUMMARY OF THE INVENTION AND ADVANTAGES

The present invention is a heat exchanger assembly. The heat exchanger assembly includes a first manifold and a second manifold spaced from the first manifold. Each of the manifolds includes a tubular wall and a pair of manifold ends spaced from each other defining a flow path. Each of the manifolds further includes a width defined within the tubular wall. A plurality of flow tubes extend between the manifolds. The flow tubes are in fluid communication with the flow paths for communicating a heat exchange fluid between the manifolds. An inlet port is defined by the first manifold. An outlet port is defined by at least one of the manifolds. The inlet and outlet ports are for communicating the heat exchange fluid to and from the heat exchanger assembly, respectively. An insert is slidably disposed in the flow path of the first manifold. The insert includes a pair of insert ends with a directing surface extending between the insert ends. A pair of side flanges integrally extends opposite each other from the directing surface of the insert. The pair of side flanges extends toward and along the tubular wall. The pair of side flanges is for orienting and securing the insert in the flow path of the first manifold. A separator integrally extends from one of the insert ends of the insert toward the tubular wall obstructing at least a portion of the width of the first manifold. The separator is for directing the heat exchange fluid through the heat exchanger assembly.

The heat exchanger assembly of the present invention provides a cost effective, flexible, and efficient solution for directing the heat exchange fluid in and out of the heat exchanger assembly. The insert directs the heat exchange fluid received from the inlet port through the first manifold through the flow tubes and out of the heat exchanger assembly through the outlet port. The inlet and outlet ports may be oriented and located at various locations to receive external plumbing connections connected to the heat exchanger assembly. The heat exchanger assembly has reduced manufacturing cost and may be configured to meet various inlet and outlet port requirements.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate corresponding parts throughout the several views, a heat exchanger assembly is shown generally at 20.

Figure 1:
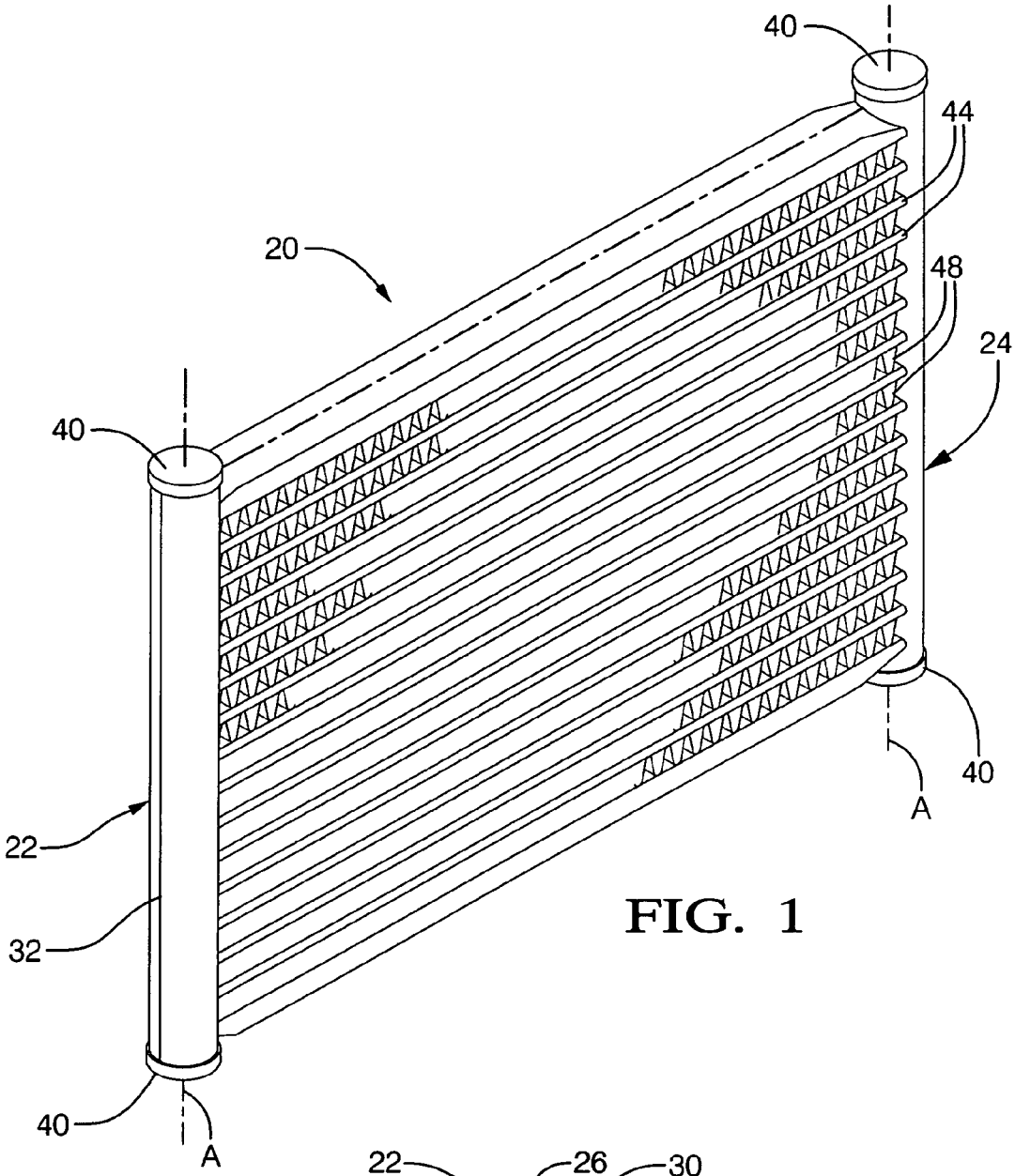
FIG. 1 is a perspective view of a heat exchanger assembly.

Referring to FIG. 1, a first embodiment of the heat exchanger assembly 20 is shown. The heat exchanger assembly 20 includes a first manifold 22 and a second manifold 24 spaced from the first manifold 22. The manifolds 22, 24 are spaced from and parallel to each other. Those of ordinary skill in the art appreciate that the manifolds 22, 24 may be non-parallel to each other. Reference to the first manifold 22 and the second manifold 24 is interchangeable in the description of the present invention.

Figure 2:
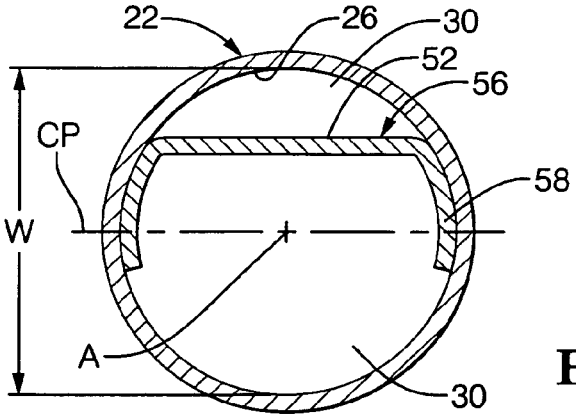
FIG. 2 is a cross-sectional side view of a first manifold and an insert disposed therein.
Figure 3:
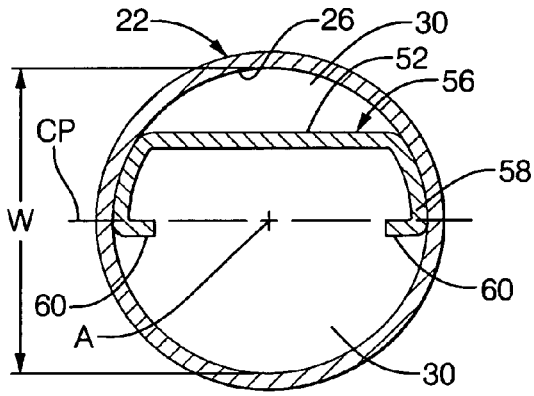
FIG. 3 is a cross-sectional side view of the first manifold and another embodiment of the insert disposed therein.
Figure 4:
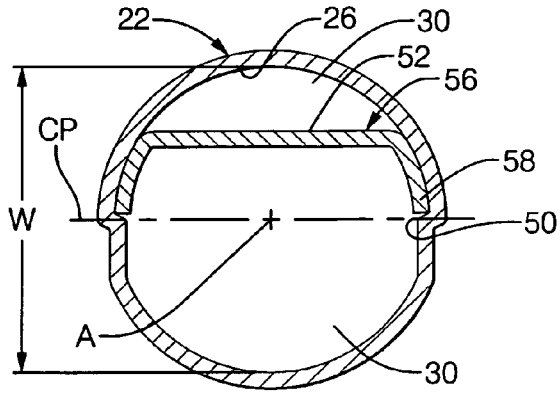
FIG. 4 is a cross-sectional side view of another embodiment of the first manifold and another embodiment of the insert disposed therein.
Figure 10:
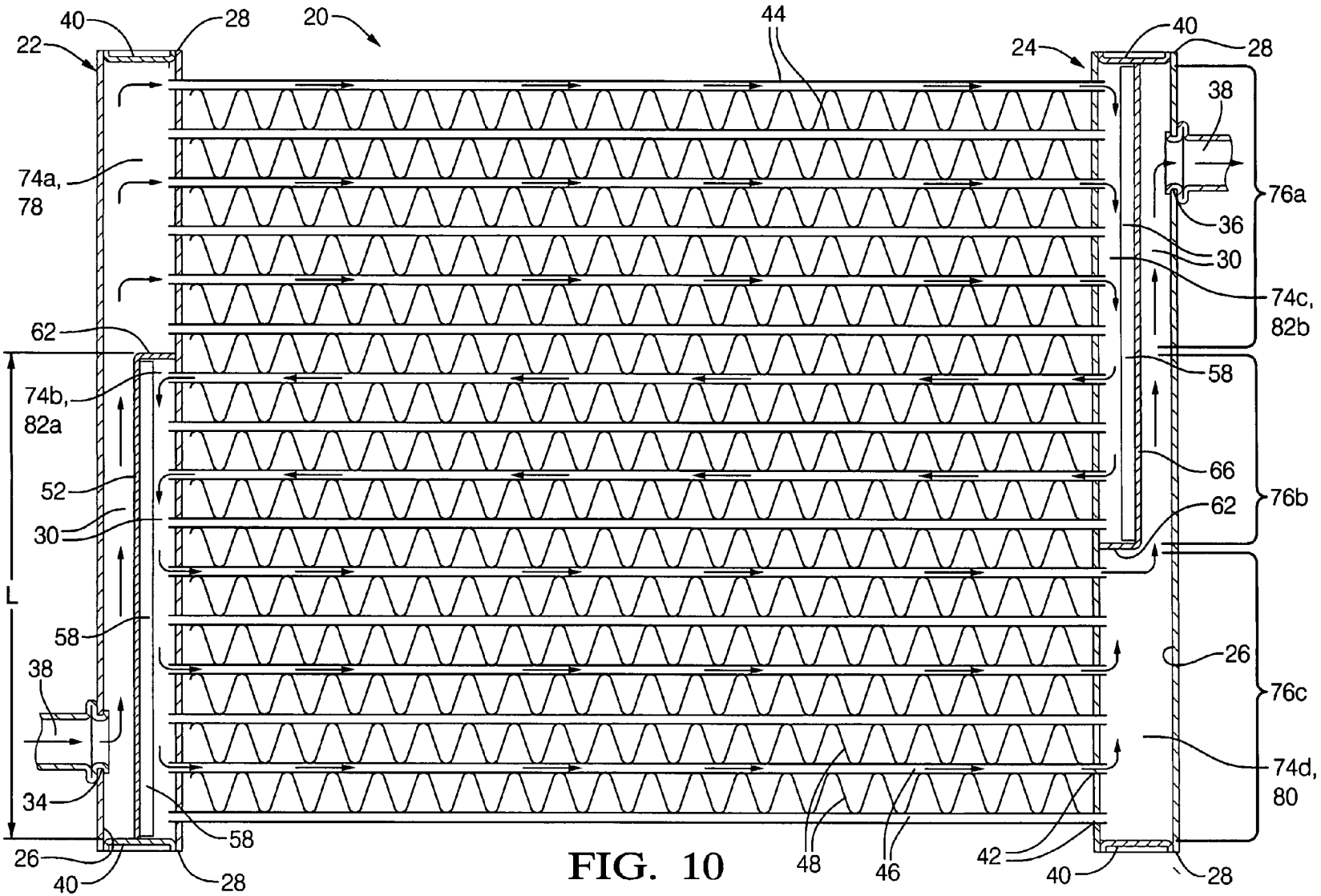
FIG. 10 is a cross-sectional side view of another embodiment of the heat exchanger assembly.
Figure 12:
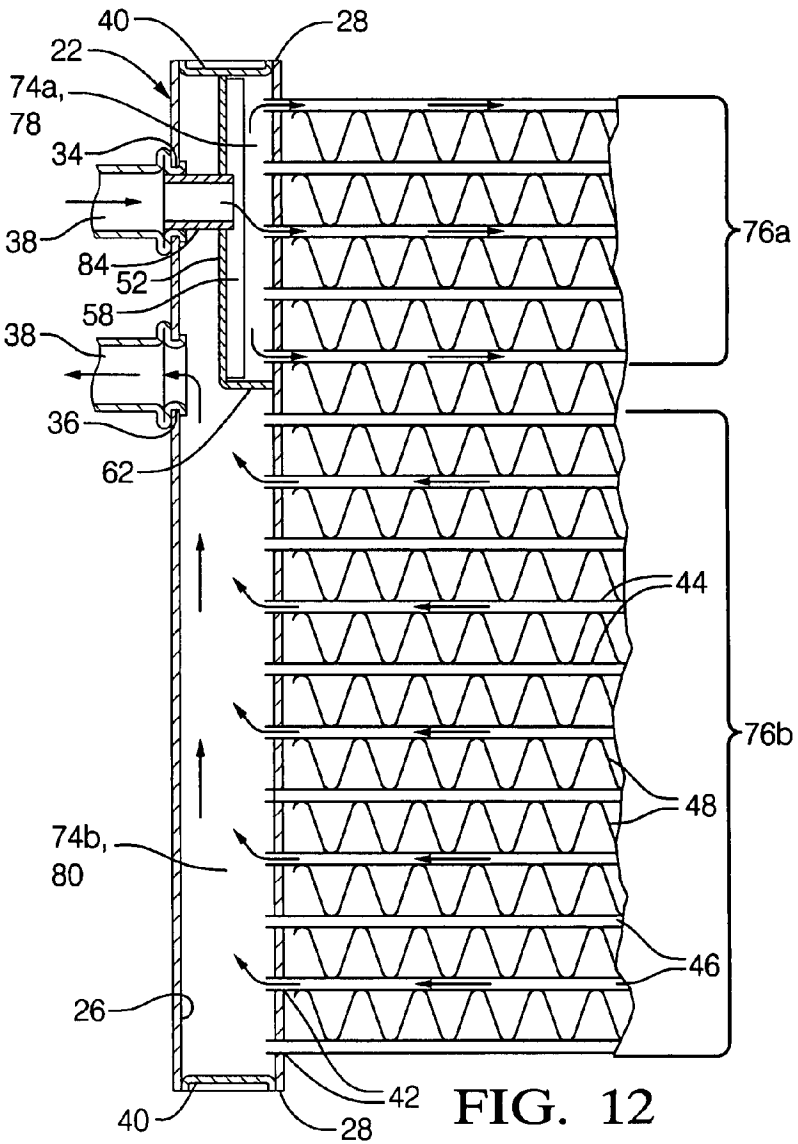
FIG. 12 is a portion of a cross-sectional side view of another embodiment of the heat exchanger assembly.
Figure 11:
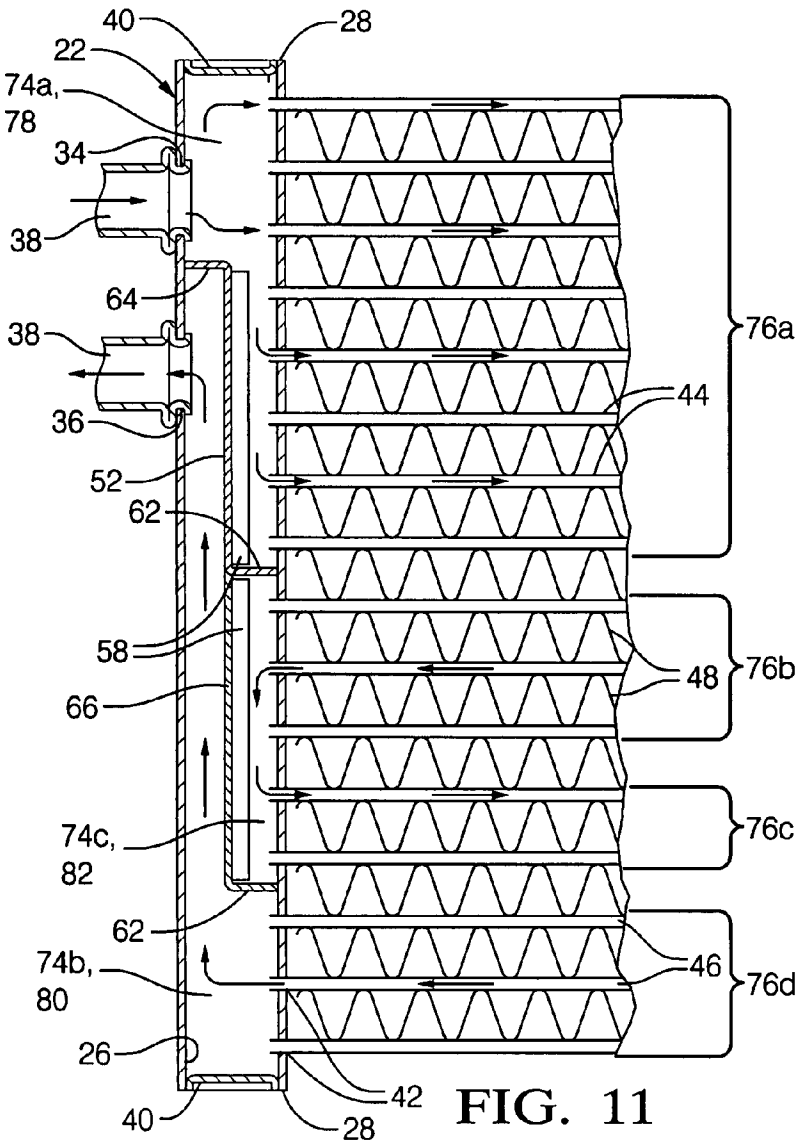
FIG. 11 is a portion of a cross-sectional side view of another embodiment of the heat exchanger assembly.
Figure 13:
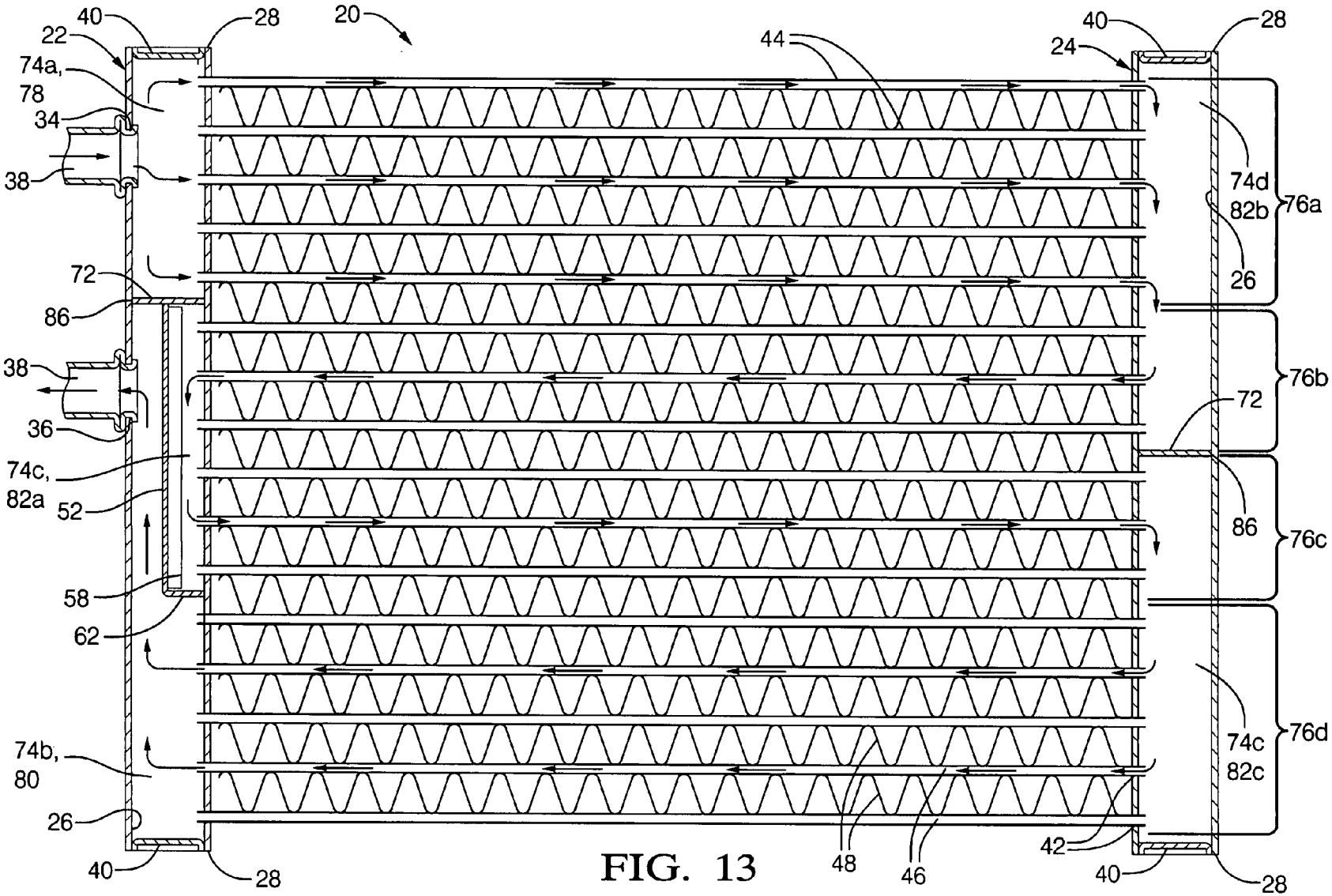
FIG. 13 is a cross-sectional side view of another embodiment of the heat exchanger assembly.
Figure 14:
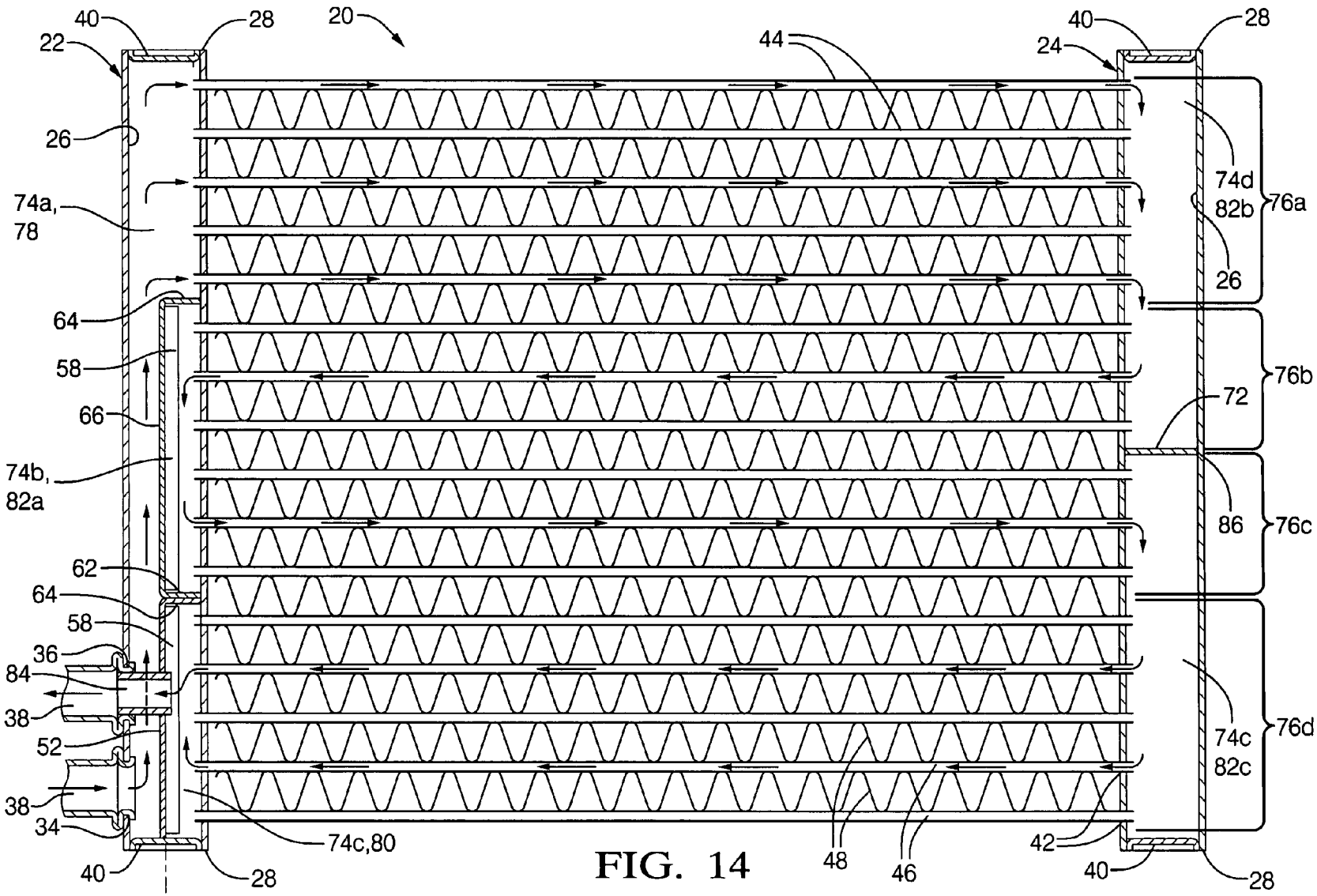
FIG. 14 is a cross-sectional side view of another embodiment of the heat exchanger assembly.
Figure 15:
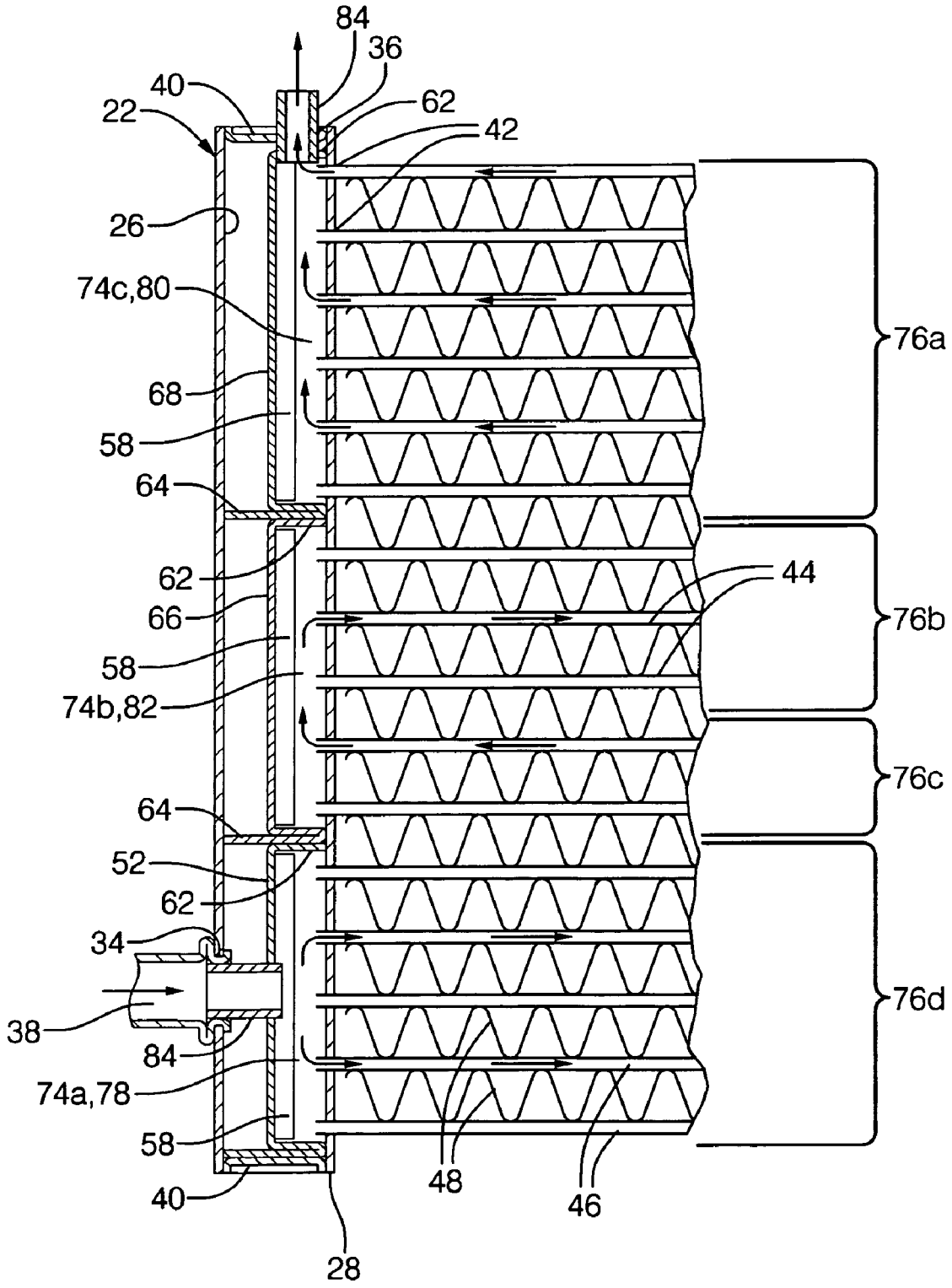
FIG. 15 is a portion of a cross-sectional side view of another embodiment of the heat exchanger assembly.

As best shown in FIGS. 10, 13, and 14, each of the manifolds 22, 24 includes a tubular wall 26 and a pair of manifold ends 28 spaced from each other defining a flow path 30. As best shown in FIGS. 11, 12, and 15, the flow path 30 extends between the manifold ends 28 of the first manifold 22. As best shown in FIGS. 2-4, the tubular wall 26 defines a circular shaped flow path 30. In other embodiments, the tubular wall 26 may define a triangular, an oval, a rectangle, a square, a polygon, or any other shaped flow path 30 as known in the art. The manifolds 22, 24 receive, hold, deliver, and distribute a heat exchange fluid, e.g., a refrigerant, within the heat exchanger assembly 20.

The tubular wall 26 may be formed by any process as known in the art. In one embodiment, the tubular wall 26 is formed by an extrusion process. In another embodiment, the tubular wall 26 is formed by a welding process such as, but not limited to, a roll forming and welding process. Welding processes are typically lower in cost than extrusion processes, which may be useful for lowering cost of the heat exchanger assembly 20. As best shown in FIG. 1, the tubular walls 26 of the manifolds 22, 24 include a pair of longitudinal edges 32 adjacent and joined to each other such that each of the manifolds 22, 24 are unitary. The pair of longitudinal edges 32 may be joined to each other by, but not limited to, a welding or brazing process.

As shown in FIG. 1, the tubular wall 26 is a single-piece. For example, the tubular wall 26 may be formed from a length of pipe. In another embodiment, the tubular wall 26 is formed from two or more pieces (not shown). For example, the tubular wall 26 may be formed from two or more pieces that are joined together by welding. The manifolds 22, 24 and therefore, the tubular walls 26, may be the same as or different from each other.

The tubular wall 26 may be formed from any material as known in the art. The material should be able to withstand temperatures and pressures encountered with use of the heat exchanger assembly 20. The material should also be suitable for heat transfer. The material may be selected from the group of, but is not limited to, metals, composites, polymers, plastics, ceramics, and combinations thereof. In one embodiment, the manifolds 22, 24 are each formed from the same material. In another embodiment, the manifolds 22, 24 are each formed from a different material, respectively.

The heat exchanger assembly 20 further includes an inlet port 34 defined by the first manifold 22. The inlet port 34 is for communicating the heat exchange fluid to the heat exchanger assembly 20. It is to be appreciated that the heat exchanger assembly 20 may include a plurality of the inlet port 34 (not shown). The inlet port 34 may comprise any size and shape. In one embodiment, one of the manifold ends 28 of the first manifold 22 defines the inlet port 34. In another embodiment, and as shown in FIGS. 10-15, a portion of the tubular wall 26 extending between the manifold ends 28 of the first manifold 22 defines the inlet port 34. It is to be appreciated that one or more of the inlet ports 34 may be defined by the first manifold 22. In addition, one or more of the inlet ports 34 may also be defined by the second manifold 24.

The heat exchanger assembly 20 further includes an outlet port 36 defined by at least one of the manifolds 22, 24. The outlet port 36 is for communicating the heat exchange fluid from the heat exchanger assembly 20. It is to be appreciated that the heat exchanger assembly 20 may include a plurality of the outlet port 36 (not shown). The outlet port 36 may comprise any size and shape. In one embodiment, and as shown in FIG. 15, one of the manifold ends 28 of one of the manifolds 22, 24 defines the outlet port 36. In another embodiment, and as shown in FIGS. 10-14, a portion of the tubular wall 26 extending between the manifold ends 28 of one of the manifolds 22, 24 defines the outlet port 36. It is to be appreciated that the one or more of the outlet ports 36 may be defined by the first manifold 22. In addition, one or more of the outlet ports 36 may also be defined by the second manifold 24.

As shown in FIGS. 11-15, plumbing connections 38 are connected to and are in fluid communication with the ports 34, 36. The plumbing connections 38 introduce and draw the heat exchange fluid to and from the heat exchanger assembly 20, respectively. The plumbing connections 38 may be any plumbing connections 38 as known in the art. For example, the plumbing connections 38 may be block fittings or block connectors (not shown). The plumbing connections 38 will be discussed in further detail below.

As best shown in FIGS. 2-4, the heat exchanger assembly 20 further includes an axis A extending centrally within the flow path 30 of the first manifold 22. A center plane CP intersects the axis A between the tubular wall 26 of the first manifold 22. A width W is also defined within the tubular wall 26 of the first manifold 22.

The heat exchanger assembly 20 may further include at least one end cap 40, and more preferably, may further include four end caps 40. As best shown in FIG. 1, the heat exchanger assembly 20 includes one end cap 40 for each one of the manifold ends 28. The end caps 40 are disposed over the manifold ends 28. In another embodiment, and as shown in FIGS. 10-15, the end caps 40 are disposed within the manifolds 22, 24 between the tubular walls 26 and proximal to the manifold ends 28. The end caps 40 seal the manifold ends 28 of the manifolds 22, 24 to retain the heat exchange fluid within the heat exchanger assembly 20.

In one embodiment, at least one of the manifold ends 28 of the manifolds 22, 24 is further defined as an end cap 40. As best shown in FIG. 15, at least one of the ports 34, 36 is also defined by the end cap 40. At least one of the end caps 40 may define a notch (not shown). The end caps 40 may be formed from any material as known in the art. The end caps 40 may be sealed onto or within the manifolds 22, 24 by any method as known in the art. For example, the end caps 40 may be sealed in place by brazing, welding, gluing or crimping. It is to be appreciated by those skilled in the art that the end caps 40 are not necessary for the present invention. The manifolds 22, 24 may be sealed by other methods known in the art. For example, the manifolds 22, 24 may be sealed by crimping the manifold ends 28 of the heat exchanger assembly 20 closed.

The heat exchanger assembly 20 typically includes a series of apertures 42 defined by the tubular wall 26 of the manifolds 22, 24. In one embodiment, and as shown in FIGS. 10-15, each of the apertures 42 are equally sized, shaped, and spaced. In other embodiments, the apertures 42 may be of different sizes, shapes, and/or spacing. Each one of the apertures 42 may be the same or different than the other apertures 42. The apertures 42 may be formed in the tubular wall 26 by any method known in the art. For example, the apertures 42 may be formed by cutting, drilling, stamping, lancing, or punching the tubular wall 26.

As best shown in FIG. 1, the heat exchanger assembly 20 further includes a plurality of flow tubes 44 extending between the manifolds 22, 24. The flow tubes 44 are in fluid communication with the flow paths 30 for communicating the heat exchange fluid between the manifolds 22, 24. The flow tubes 44 also transfer energy, i.e., heat, to or from ambient air surrounding the flow tubes 44. The flow tubes 44 extend in parallel between the manifolds. Those of ordinary skill in the art appreciate that the flow tubes 44 may be nonparallel to each other.

The flow tubes 44 may define any shape. In one embodiment, as shown in FIG. 1, each of the flow tubes 44 is substantially rectangular with round edges. In other embodiments, the flow tubes 44 may be circular, triangular, square, polygon, or any other shape known to those skilled in the art. Each one of the flow tubes 44 may be the same as or different than the other flow tubes 44. As shown in FIGS. 10-15, the flow tubes 44 extend through the apertures 42 of the tubular wall 26 and partially into the flow path 30. In another embodiment, the flow tubes 44 extend through the apertures 42 and stop short of the flow path 30 (not shown). In yet another embodiment, the flow tubes 44 extend to and contact the tubular wall 26 in alignment with the apertures 42 (not shown).

The flow tubes 44 may be formed from any material as known in the art. The flow tubes 44 may be attached to the manifolds 22, 24 by any method, such as by, but not limited to, brazing, welding, gluing, or pressing the flow tubes 44 to the manifolds 22, 24. The flow tubes 44 may be formed by any method as known in the art. For example, the flow tubes 44 may be formed by an extrusion or welding process. As shown in FIGS. 10-15, each one of the flow tubes 44 defines a passage 46 therein. In another embodiment, each one of the flow tubes 44 defines a plurality of passages 46 therein (not shown). All of the passages 46 are preferably in fluid communication with the flow paths 30 of the manifolds 22, 24.

The passages 46 may be of any number. The passages 46 may also be of any shape and size. For example, the passages 46 may be circular, oval, triangular, square, or rectangular in shape. Each one of the passages 46 may be the same as or different than the other passages 46. The passages 46 decrease a volume to surface area ratio of the heat exchange fluid within the flow tube 46, which increases performance of the heat exchanger assembly 20.

The heat exchanger assembly 20 may further include a plurality of air fins 48. As best shown in FIG. 1, the air fins 48 are disposed between the flow tubes 44 and the manifolds 22, 24. In another embodiment, the airs fins 48 are disposed on each one of the flow tubes 44 (not shown). The air fins 48 may be disposed on and/or between the flow tubes 44 in any arrangement known in the art, such as, but not limited to, a corrugated or stacked plate fin arrangement. The air fins 48 may be formed from any material as known in the art. The air fins 48 may be attached to the flow tubes 44 by any method, such as, but not limited to, brazing, welding, gluing, or pressing the air fins 48 onto and/or between the flow tubes 44. The air fins 48 increase surface areas of the flow tubes 44, which further increases performance of the heat exchanger assembly 20.

The heat exchanger assembly 20 may further include at least two indentations 50. As shown in FIG. 4, the tubular wall 26 of the first manifold 22 defines the indentations 50 with each of the indentations 50 spaced from and opposite the other. In another embodiment, the heat exchanger assembly 20 includes a plurality of the indentations 50 (not shown). For example, the first manifold 22 may include one pair of indentations 50 for each one of the apertures 42. It is to be appreciated that the indentations 50 may be in various locations and configurations. For example, the indentations 50 may run a length of the flow path 30 in a series. In addition, the indentations 50 may be connected and span an entire length of the flow path 30. Further, the indentations 50 may also be individual and discrete elements. The indentations 50 may be formed by any method known in the art, such as, but not limited to, extruding, pressing, crimping, or punching the tubular wall 26 of the first manifold 22. In one embodiment, the indentations 50 are formed while forming the apertures 42.

The heat exchanger assembly 20 further includes an insert 52. The insert 52 has a pair of insert ends 54 with a directing surface 56 extending between the insert ends 54. As best shown in FIG. 10, the insert 52 is slidably disposed in the flow path 30 of the first manifold 22. In one embodiment, the insert 52 is removable from the flow path 30 of the first manifold 22. For example, the insert 52 may be slidably removable from the flow path 30 for changing orientation and location of the insert 52 or for cleaning the tubular wall 26 of the first manifold 22. In another embodiment, the insert 52 is fixed in the flow path 30 of the first manifold 22. For example, the insert 52 may be fixed by brazing, welding, gluing, pressing, or crimping the insert 52 to the tubular wall 26 in the flow path 30 of the first manifold 20 to maintain the orientation and location of the insert 52. In yet another embodiment, the insert 52 is movable in the flow path 30. For example, the insert 52 may be slidably moveable for forming a plurality of configurations within the heat exchanger assembly 20.

The insert 52 may be formed from any material as known in the art. The material should be able to withstand temperatures and pressures encountered in the heat exchanger assembly 20. The insert 52 may be slidably disposed in the flow path 30 before or after the heat exchanger assembly 20 is fully assembled, i.e., made. For example, the insert 52 may be slidably disposed in the flow path 30 of the first manifold 22 after the flow tubes 30 are attached to the manifolds 22, 24. It is to be appreciated that the directing surface 56 does not need to be parallel to the flow tubes 44 and may be at any angle relative to the flow tubes 44. As best shown in FIGS. 2-4, the directing surface 56 of the insert 52 is spaced from and parallel to the center plane CP. However, the directing surface 56 may be disposed on the center plane CP and/or at an angle thereto.

The insert 52 may be formed by any method as known in the art. For example, the insert 52 may be formed by an extrusion process, a welding process, a stamping process, or a roll-forming process. The insert 52 may be of any thickness. The thickness of the insert 52 should be able to withstand pressures encountered in the heat exchanger assembly 20.

An insert length L extends between the insert ends 54. As best shown in FIG. 10, the insert length L is less than a length of the flow path 30 of the first manifold 22. In another embodiment, the insert length L is equal to the length of the flow path 30 of the first manifold 22 (not shown). In yet another embodiment, the insert length L is greater than the length of the flow path 30 of the first manifold 22 (not shown). This may occur when the end caps 40 are disposed over each one of the manifold ends 28 and the insert ends 54 abut the end caps 40. As best shown in FIGS. 10 and 12, the insert ends 54 mechanically engage the notches of the end caps 40 for orienting and securing the insert 52 in the flow path 30. In other embodiments, the insert ends 54 may mechanically engage other features of the end caps 40 formed therein and/or extending therefrom such as, but not limited to, a lip (not shown). It is to be appreciated that the insert ends 54 may be of various shapes, sizes, and configurations for engagement.

The heat exchanger assembly 20 further includes a pair of side flanges 58 integrally extending opposite each other from the directing surface 56 of the insert 52. As best shown in FIGS. 2-4, the pair of side flanges 58 extends toward and along the tubular wall 26. The pair of side flanges 58 orients and secures the insert 52 in the flow path 30 of the first manifold 22. In one embodiment, and as shown in FIGS. 2-4, the side flanges 58 extend in the same direction, i.e., both of the side flanges 58 extend toward the apertures 42 (not shown). It is to be appreciated that both of the side flanges 58 may extend away from the apertures 42. In another embodiment, the side flanges 58 extend in opposite directions (not shown). For example, one of the side flanges 58 extends toward the apertures 42, and the other side flange 58 extends away from the apertures 42. The heat exchanger assembly 20 may further include additional side flanges (not shown) extending from the directing surface 56 of the insert 52. It is to be appreciated that in other embodiments, the side flanges 58 may be edges of the directing surface 56, i.e., be coplanar with the directing surface 56, such that the side flanges 58 extend to and abut along the tubular wall 26. In these embodiments, the side flanges 58 do not extend upwardly or downwardly from the directing surface 56.

As shown in FIGS. 2-4, the side flanges 58 and the tubular wall 26 are complimentarily curved, which may be useful for orienting and securing the insert 52 in the flow path 30. It is to be appreciated that the side flanges 58 and the tubular wall 26 do not need to be complimentarily curved. For example, only a portion of each of the side flanges 58 may extend along and/or be in contact with the tubular wall 26 to maintain the insert 52 within the flow path 30.

The side flanges 58 may be formed from any material as known in the art. As shown in FIGS. 5-9, the side flanges 58 and the directing surface 56 are homogeneous, i.e., the side flanges 58 are extensions of the directing surface 56. In other embodiments, at least one of the side flanges 58 is a separate and distinct piece (not shown). In these embodiments, at least one of or both of the side flanges 58 may be attached to the directing surface 56 by, for example, a weld. As shown in FIG. 4, the side flanges 58 mechanically engage the indentations 50 of the tubular wall 26, which may be useful for orienting and securing the insert 52 in the flow path 30. As shown in FIG. 2, the side flanges 58 extend from the directing surface 56 along the tubular wall 26 toward and across the center plane CP, which may be useful for further orienting and securing the insert 52 in the flow path 26 of the first manifold 22.

The heat exchanger assembly 20 may further include a pair of tips 60 with each tip 60 spaced from and opposite the other. As shown in FIG. 3, one of the tips 60 curves to extend from one of the side flanges 58 substantially parallel to the directing surface 56 of the insert 52. The other tip 60 also curves to extend from the other side flange 58 substantially parallel to the directing surface 56 of the insert 52. It is to be appreciated that the tips 60 may be at different angles relative to one another. By "substantially parallel", it is meant that the tips 60 are preferably as close to parallel as possible, but may also have a slight deviation in angle due to, for example, manufacturing tolerances.

At least one of the flow tubes 44 may extend toward the center plane CP and mechanically engage at least one of the tips 60 of the insert 52 (not shown). The flow tube 44 may be useful for orienting the insert 52 within the flow path 30 during, for example, manufacture of the heat exchanger assembly 20. For example, the flow tube 44 may be pushed into the aperture 42 and mechanically engage one of the tips 60. The insert 52 will rotate within the flow path 30 and the other tip 60 will mechanically engage the flow tube 44. If this example is utilized, the directing surface 56 will be substantially parallel to the aperture 42. Alternatively, the insert 52 may be rotated to a certain degree which is not parallel to the aperture 42.

Figure 5:
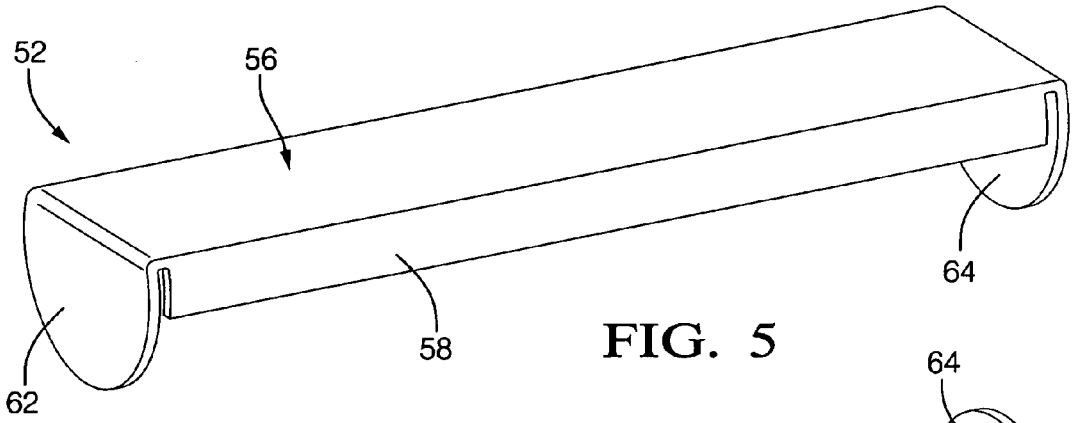
FIG. 5 is a perspective view of another embodiment of the insert.
Figure 6:
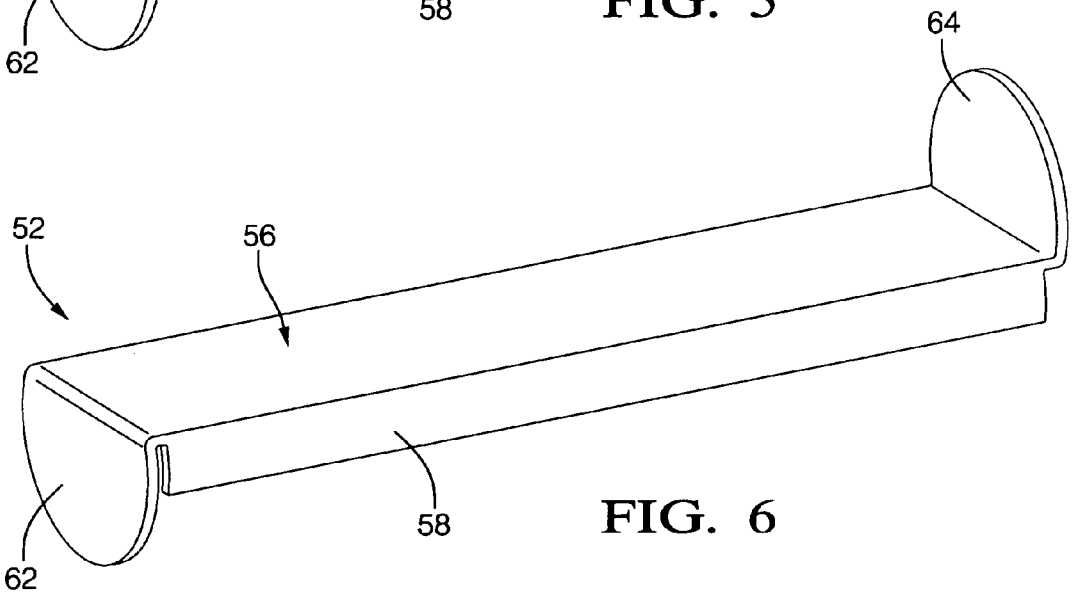
FIG. 6 is a perspective view of another embodiment of the insert.

The heat exchanger assembly 20 further includes a separator 62 integrally extending from one of the insert ends 54 of the insert 52 toward the tubular wall 26. As shown in FIGS. 10-15, the separator 62 obstructs at least a portion of the width W of the first manifold 22. The separator 62 is for directing the heat exchange fluid through the heat exchanger assembly 20. The separator 62 may extend from one of the insert ends 54 at any angle relative to the directing surface 56 of the insert 52. For example, the separator 62 may extend at an angle that is from about 45 to about 135 degrees relative to the directing surface 56 of the insert 52. As best shown in FIGS. 5 and 6, the angle is about 90 degrees relative to the directing surface 56 of the insert 52. It is to be appreciated that the separator 62 may extend at any angle relative to the directing surface 56 of the insert 52.

The separator 62 may be formed from any material as known in the art. As shown in FIGS. 5, 6, 8, and 9, the separator 62 and the directing surface 56 are homogenous, i.e., the separator 62 is an extension of the directing surface 56. In another embodiment, the separator 62 is a separate and distinct piece (not shown) that is attached to the directing surface 56 by, for example, a weld.

The heat exchanger assembly 20 may further include a second separator 64 integrally extending from the insert end 54 of the insert 52 opposite the separator 62 toward the tubular wall 26. As best shown in FIG. 11, the second separator 64 obstructs at least a portion of the width W of the first manifold 22. Like the separator 62, the second separator 64 may also extend from one of the insert ends 54 at any angle relative to the directing surface 56 of the insert 52. As best shown in FIG. 5, the separators 62, 64 extend in the same direction. As best shown in FIG. 6, the separators 62, 64 extend in opposite directions. It is to be appreciated that the heat exchanger assembly 20 may further include additional separators (not shown) extending from the directing surface 56 of the insert 52.

The second separator 64 may be formed from any material as known in the art. As shown in FIGS. 5 and 6, the second separator 64 and the directing surface 56 are homogenous, i.e., the second separator 64 is an extension of the directing surface 56. In another embodiment, the separator 64 is a separate and distinct piece (not shown) that is attached to the directing surface 56 by, for example, a weld.

Figure 7:
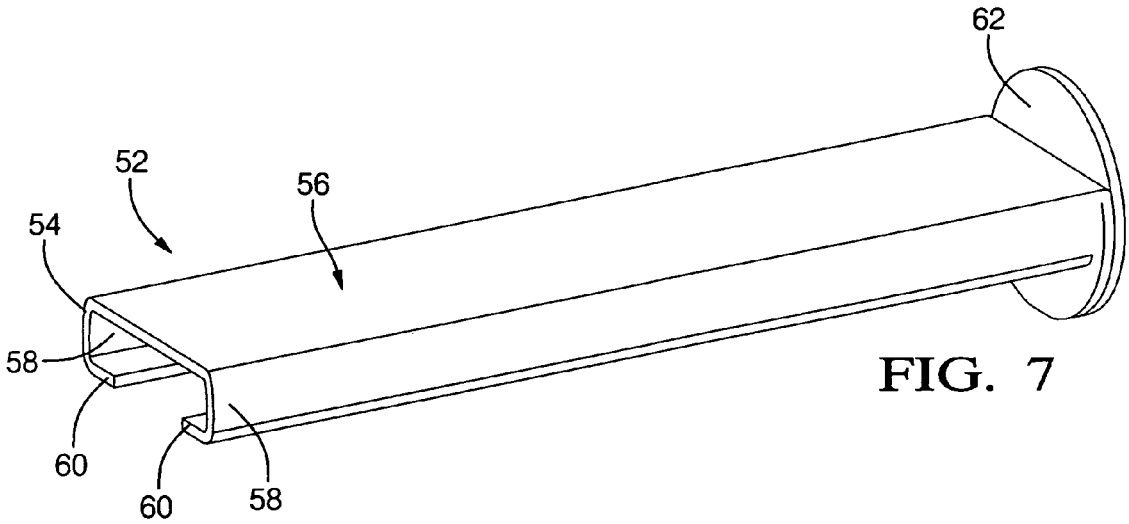
FIG. 7 is a perspective view of another embodiment of the insert.
Figure 8:
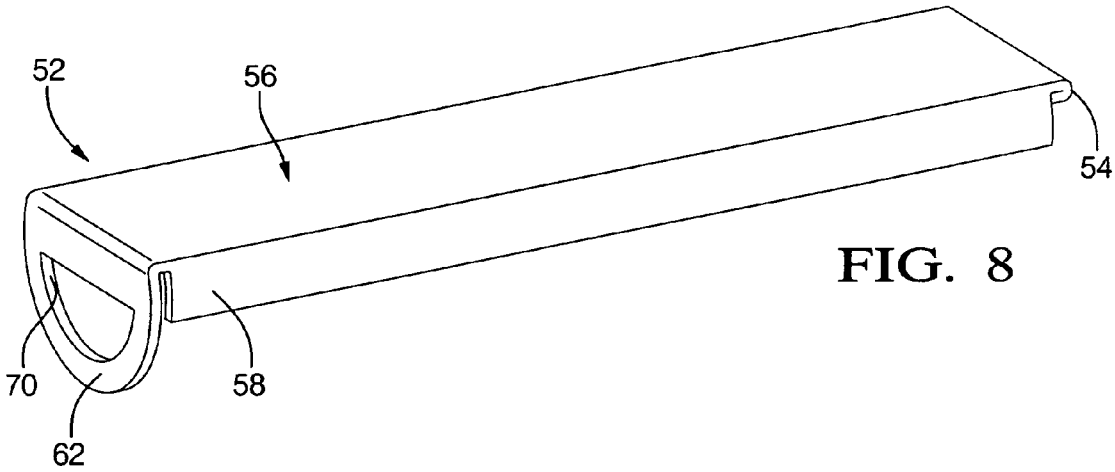
FIG. 8 is a perspective view of another embodiment of the insert.
Figure 9:
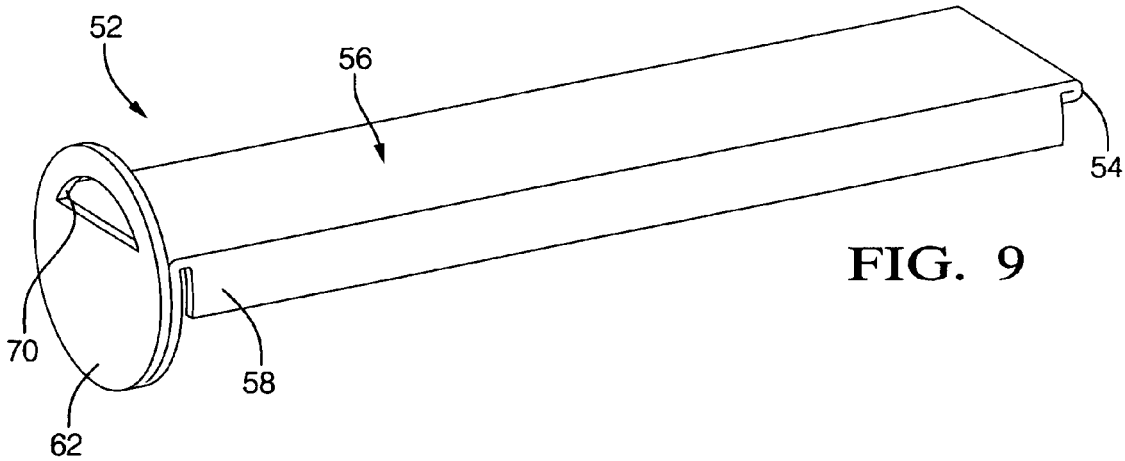
FIG. 9 is a perspective view of another embodiment of the insert.

As best shown in FIGS. 7 and 15, at least one of the separators 62, 64 may be configured to obstruct an entirety of the width W of the first manifold 22, which is useful for directing the heat exchange fluid through the heat exchanger assembly 20. At least one of the separators 62, 64 may define at least one hole 70, as shown in FIGS. 8 and 9. It is to be appreciated that the hole 70 may be of any size or shape. The hole 70 may be useful for directing the heat exchange fluid through the heat exchanger assembly 20.

The heat exchanger assembly 20 may further include a second insert 66 slidably disposed in one of the manifolds 22, 24. The insert 52 and the second insert 66 may be identical. Said another way, the second insert 66 may be the same size, shape, or configuration as the insert 52. However, it is to be appreciated that the second insert 66 may be different from the insert 52. For example, and as shown in FIG. 14, the insert 52 may include the separator 62, and the second insert 66 may include the second separator 64 and another one of the separator 62.

As shown in FIG. 10, the second insert 66 is slidably disposed in the flow path 30 of the second manifold 24. The insert 52 and the second insert 66 are shown as being identical in size, shape, and configuration. As shown in FIG. 11, the second insert 66 is slidably disposed in the flow path 30 of the first manifold 22 along with the insert 52. The second insert 66 is shown as a different configuration compared to the insert 52. The second insert 66 may abut the insert 52 or alternatively, the inserts 52, 62 may be spaced from each other within the same manifold 22, 24. In addition, the inserts 52, 66 may be in side by side position that occupies at least a portion of the same length of the manifold 22, 24 (not shown). For example, the directing surfaces 56 of the inserts 52, 66, respectively, may be parallel to and spaced from each other and the center plane CP.

The heat exchanger assembly 20 may further include a third insert 68. As shown in FIG. 15, the third insert 68 is slidably disposed in flow path 30 of the first manifold 22 along with the insert 52 and the second insert 66. Like the second insert 66, the third insert 68 may be the same or different than the insert 52. In addition, the third insert 68 may be the same or different than the second insert 66. It is to be appreciated that the inserts 52, 66, 68 may be in various locations within the heat exchanger assembly 20. In addition, the inserts 52, 66, 68 may be of varying sizes, shapes, and configurations relative to each other. It is also to be appreciated that the heat exchanger assembly 20 may further include additional inserts (not shown) slidably disposed in the flow paths 30 of the manifolds 22, 24. To reduce cost of manufacturing the heat exchanger assembly 20, two or more of the inserts 52, 66, 68 may be inserted as a subassembly into one of the manifolds 22, 24. For example, the insert 52 and second insert 66 may be attached to each other and slid into the first manifold 22. However, it is to be appreciated that the inserts 52, 66, 68 may be inserted individually into the manifolds 22, 24.

The heat exchanger assembly 20 may further include at least one baffle 72 slidably disposed in the flow path 30 of one of the manifolds 22, 24. The baffle 72 has a perimeter 86. At least a portion of the perimeter 86 contacts the tubular wall 26 such that the baffle 72 obstructs at least a portion of the width W of the manifold 22, 24. The baffle 72 may be useful for directing the heat exchange fluid through the heat exchanger assembly 20. The baffle 72 more preferably obstructs an entirety of the width W. As shown in FIGS. 13 and 14, two of the baffles 72 are slidably disposed in the flow path 30 of the first manifold 22 and the second manifold 24, respectively. The baffle 72 may define a notch (not shown). One of the insert ends 54 of the insert 52 may mechanically engage the notch of the baffle 72. As shown in FIG. 13, the insert end 54 opposite the separator 62 of the insert 52 abuts the baffle 72. In other embodiments, the baffle 72 may be used as the separator 62 and/or the second separator 64 of one or more of the inserts 52, 66, 68. For example, the insert end 54 of the directing surface 56 may abut the baffle 72 to establish the separator 62 of the insert 52. Preferably, the insert end 54 and the baffle 72 are joined in a manner for sealing engagement to prevent the heat exchange fluid from flowing therebetween. For example, the insert end 54 may be welded or press fitted to the baffle 72 to establish the separator 62 of the insert 52. The baffle 72 may define at least one hole (not shown). It is to be appreciated that the hole may be of any size or shape. The hole of the baffle 72 may be useful for directing the heat exchange fluid through the heat exchanger assembly 20.

The heat exchanger assembly 20 may further include a series of orifices (not shown) defined in the directing surface 56 of the insert 52. The orifices may be useful for uniformly distributing the heat exchange fluid between the flow path 30 and the flow tubes 44.

The insert 52 divides the flow path 30 of the first manifold 22 into a plurality of chambers 74. As best shown in FIG. 10, the insert 52 divides the flow path 30 of the first manifold 22 into a first chamber 74*a* and a second chamber 74*b*. In addition, the second insert 66 divides the flow path 30 of the second manifold 24 into a third chamber 74*c* and a fourth chamber 74*d*. As shown in FIGS. 11 and 14, the inserts 52, 66 cooperate to divide the flow path 30 of the first manifold 22 into the chambers 74*a*, 74*b*, 74*c*. As shown in FIG. 13, the insert 52 and two of the baffles 72 cooperate to divide the flow paths 30 of the manifolds 22, 24 into a fifth chamber 74*e* and the chambers 74*a*, 74*b*, 74*c*, 74*d*. As shown in FIG. 14, the inserts 52, 66 cooperate with the baffle 72 to divide the flow paths 30 into the chambers 74*a*, 74*b*, 74*c*, 74*d*, 74*e*. As shown in FIG. 15, the inserts 52, 66, 68 cooperate to divide the flow path 30 of the first manifold 22 into the chambers 74*a*, 74*b*, 74*c*. It is to be appreciated that one or more of the inserts 52, 66, 68 and, optionally, one or more of the baffles 72, may be in various configurations to establish the chambers 74. It is also to be appreciated that the heat exchanger assembly 20 may have any number of the chambers 74.

The chambers 74 and the flow tubes 44 cooperate to establish a plurality of flow passes 76 in the heat exchanger assembly 20. The heat exchange fluid travels back and forth in the flow passes 76 between the manifolds 22, 24. As shown in FIG. 12, the heat exchanger assembly 20 includes a first flow pass 76*a* and a second flow pass 76*b*. As shown in FIG. 10, the heat exchanger assembly 20 further includes a third flow pass 76*c*. In addition, the insert end 54 of the insert 52 opposite the separator 60 abuts one of the manifold ends 28, i.e., the end cap 40, for establishing the plurality of flow passes 76. As shown in FIGS. 11 and 13-15, the heat exchanger assembly 20 further includes a fourth flow pass 76*d*. As shown in FIG. 11, the second separator 62 extends towards the tubular wall 26 for establishing the plurality of flow passes 76. It is to be appreciated that the heat exchanger assembly 20 may have any number of the flow passes 76. Both of the ports 34, 36 are typically defined in one of the manifolds 22, 24 when there is an even number, e.g., 2, 4, 6, etc., of the flow passes 76. Conversely, each one of the ports 34, 36 is defined in one of the manifolds 22, 24, respectively, when there is an odd number, e.g., 1, 3, 5, etc., of the flow passes 76.

As shown in FIG. 12, the first chamber 74*a* is further defined as an inlet chamber 78. The inlet chamber 78 is in fluid communication with the inlet port 34. The inlet chamber 78 is for communicating the heat exchange fluid from the inlet port 34 to the plurality of flow passes 76. As also shown in FIG. 12, the second chamber 74*b* is further defined as an outlet chamber 80. The outlet chamber 80 is in fluid communication with the outlet port 36 for communicating the heat exchange fluid from the plurality of flow passes 76 to the outlet port 36. It is to be appreciated that the heat exchanger assembly 20 may have any number of the inlet chambers 78 and any number of the outlet chambers 80.

As best shown in FIG. 10, the first chamber 74*a* is further defined as the inlet chamber 78. In addition, the second chamber 74*b* is further defined as a return chamber 82, and more specifically, the second chamber 74*b* is further defined as a first return chamber 82*a*. The return chamber 82 is in fluid communication with at least two of the passes 76. The return chamber 82 is for directing the heat exchange fluid from one of the flow passes 76 to a subsequent flow pass 76. For example, the return chamber 82 may receive the heat exchange fluid from the second flow pass 76*b* and return, i.e., direct, the heat exchange fluid to the third flow pass 76*c*. As shown in FIGS. 10 and 15, the heat exchanger assembly 20 further includes a second return chamber 82*b*. As shown in FIGS. 13 and 14, the heat exchanger assembly 20 further includes a third return chamber 82*c*. It is to be appreciated that the heat exchanger assembly 20 may have any number of the return chambers 82. In another embodiment (not shown), the first chamber 74*a* is further defined as an outlet chamber 80 in fluid communication with the outlet port 36 for communicating the heat exchange fluid from the plurality of flow passes 76 to the outlet port 36. Further, the second chamber 74*b* is further defined as a return chamber 82 in fluid communication with at least two of the plurality of passes 76 for directing the heat exchange fluid from one of the plurality of plow passes 76 to a subsequent flow pass 76. A similar embodiment is shown in FIG. 10, where the second insert 66 divides the flow path 30 of the second manifold 24 for establishing the second return chamber 82*b* and the outlet chamber 80. It is to be appreciated that any one of the chambers 74 may be further defined as the inlet chamber 78, the outlet chamber 80, or the return chamber 82.

The heat exchanger assembly 20 may further include a tube 84 extending from one of the ports 34, 36 into the manifold 22, 24. The tube 84 may further extend to and through the insert 52 for communicating the heat exchange fluid to or from at least one of the chambers 74. As shown in FIG. 14, the tube 84 extends through the directing surface 56 of the insert 52 and is in fluid communication with the outlet chamber 80. It is to be appreciated that the tube 84 may extend to and through at least one of the separators 60, 62 and/or at least one of the side flanges 58. In addition, the tube 84 may also extend through at least one of the baffles 72, if present. The tube 84 may be useful for manufacturing purposes. For example, the tube 84 may connect to and extend at least one of the plumbing connections 38 into the heat exchanger assembly 20 to communicate directly with one or more of the chambers 74, 78, 80, 82.

The ports 34, 36 and therefore, the plumbing connections 38, may be defined anywhere by and located anywhere on the manifolds 22, 24, respectively. Said another way, the inlet chamber 78, the outlet chamber 80, and optionally, the return chamber 82, allow the plumbing connections 38 to be oriented and located at various positions along one of or both of the manifolds 22, 24. As such, the heat exchanger assembly 20 may be made into various configurations, which may be useful for manufacturers and consumers. For example, a consumer may choose where to place the ports 36, 38 depending on specific orienting and locating needs of the plumbing connections 38. As shown in FIG. 10, the plumbing connections 38 are in fluid communication with the inlet chamber 78 and the outlet chamber 80, and are located diagonal to each other. As shown in FIGS. 11-14, the plumbing connections 38 are in fluid communication with the inlet chamber 78 and the outlet chamber 80, and are located proximal to each other. It is to be appreciated that the plumbing connections 38 may be located anywhere with respect to each other while in fluid communication with the chambers 78, 80.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A heat exchanger assembly comprising:

a first manifold extending along an axis;

a second manifold extending along an axis in spaced and parallel relationship with said first manifold;

each of said manifolds including a pair of manifold ends spaced from each other;

each of said manifolds having a tubular wall extending between said manifold ends to define a flow path;

said tubular wall of each of said manifolds defining a plurality of tube apertures being spaced from each other;

a plurality of flow tubes extending between said tube apertures of said manifolds and in fluid communication with said flow paths for communicating a heat exchange fluid between said manifolds;

a plurality of air fins disposed between said flow tubes for increasing the surface area of said flow tubes;

said tubular wall of said first manifold defining a plurality of spaced and opposing indentations;

an insert disposed in and dividing said flow path of said first manifold and presenting a directing surface; and a pair of side flanges integrally connected to said insert and extending from said directing surface of said insert and along said tubular wall of said first manifold and engaging said indentations for orienting and securing said insert against rotation in said flow path of said first manifold.

2. The assembly as set forth in claim 1 wherein each of said side flanges has a cross-section presenting a curve to complement said tubular wall of said first manifold.

3. The assembly as set forth in claim 1 and including an end cap disposed at each of said manifold ends of said first and second manifolds for sealing said manifold ends to retain a heat exchange fluid within said heat exchanger assembly.

4. The assembly as set forth in claim 1 wherein said tubular wall of each of said first and second manifolds presents a cross-section having a circular shape and extending between said manifold ends to define a circular-shaped flow path.

5. The assembly as set forth in claim 4 wherein said circular-shape cross-section of said tubular wall of each of said first and second manifolds defines a diameter width.

6. The assembly as set forth in claim 5 wherein said insert includes at least one separator integrally connected to said directing surface at one of said insert ends and extending outwardly toward said tubular wall of said first manifold for obstructing at least a portion of the width of said first manifold and for directing the heat exchange fluid through said heat exchanger assembly.

7. The assembly as set forth in claim 1 wherein at least one of said first and second manifolds defines an inlet port for communicating the heat exchange fluid to said heat exchanger assembly.

8. The assembly as set forth in claim 1 wherein at least one of said first and second manifolds defines an outlet port for communicating the heat exchange fluid from said heat exchanger assembly.

9. The assembly as set forth in claim 1 wherein said air fins define a plurality of corrugations.

10. A heat exchanger assembly comprising:

a first manifold extending along an axis;

a second manifold extending along an axis in spaced and parallel relationship with said first manifold;

each of said manifolds including a pair of manifold ends spaced from each other;

an end cap disposed at each of said manifold ends of said first and second manifolds for sealing said manifold ends to retain a heat exchange fluid within said heat exchanger assembly;

each of said manifolds having a tubular wall presenting a cross-section having a circular shape and extending between said manifold ends to define a circular-shaped flow path;

said tubular wall of each of said manifolds defining a diameter width;

at least one of said first and second manifolds defining an inlet port for communicating the heat exchange fluid to said heat exchanger assembly;

at least one of said first and second manifolds defining an outlet port for communicating the heat exchange fluid from said heat exchanger assembly;

said tubular wall of each of said manifolds defining a plurality of tube apertures being spaced from each other;

a plurality of flow tubes extending between said tube apertures of said manifolds and in fluid communication with said flow paths for communicating a heat exchange fluid between said manifolds;

a plurality of air fins being corrugated and disposed between said flow tubes for increasing the surface area of the flow tubes;

said tubular wall of said first manifold defining a plurality of spaced and opposing indentations;

an insert disposed in said flow path of said first manifold;

each insert having a pair of insert ends and a directing surface extending therebetween;

said insert dividing said flow path of said first manifold into a first chamber and a second chamber with said chambers and said flow tubes cooperating to establish a plurality of flow passes;

a tube extending from at least one of said inlet and outlet ports through said at least one insert for establishing fluid communication with at least one of said chambers;

a pair of side flanges integrally connected to each insert and extending from said directing surface of said insert and along said tubular wall of said first manifold;

said pair of side flanges having a cross-section presenting a curve to complement said circular cross-section of said tubular wall of said first manifold;

said pair of side flanges extending along said tubular wall of said first manifold and engaging said indentations for orienting and securing said insert against rotation in said flow path of said first manifold;

said insert including at least one separator integrally connected to said directing surface at one of said insert ends and extending outwardly toward said tubular wall of said first manifold for obstructing at least a portion of the width of said first manifold and for directing the heat exchange fluid through said heat exchanger assembly;

at least one of said separators defining a hole for directing the heat exchange fluid through the heat exchanger assembly;

at least one baffle slidably disposed in said flow path of one of said first and second manifolds and having a perimeter engaging said tubular wall for obstructing at least a portion of the width of said corresponding manifold;

said first chamber being further defined as an inlet chamber in fluid communication with said inlet port for communicating the heat exchange fluid from said inlet port to said plurality of flow passes and wherein said second chamber is further defined as an outlet chamber in fluid communication with said outlet port for communicating the heat exchange fluid from said plurality of flow passes to said outlet port; and at least one of said separators integrally extending from one of said insert ends of said insert toward said tubular wall for obstructing at least a portion of said width of said first manifold to direct the heat exchange fluid through said heat exchanger assembly.

* * * * *